United States Patent [19]

Wallner et al.

[11] 4,289,541

[45] Sep. 15, 1981

[54] PROCESS OF CLEANING AN AUSTENITIC STEEL SURFACE

[75] Inventors: Felix Wallner; Walter Lugscheider, both of Linz, Austria

[73] Assignee: Vereinigte Oesterreichische Eisen-und Sthl-Werke Alpine Montan Akteingesellschaft, Vienna, Austria

[21] Appl. No.: 13,735

[22] Filed: Feb. 21, 1979

Related U.S. Application Data

[63] Continuation of Ser. No. 816,864, Jul. 18, 1977, abandoned, which is a continuation-in-part of Ser. No. 692,531, Jun. 3, 1976, abandoned.

[30] Foreign Application Priority Data

Sep. 25, 1975 [AT] Austria ..... 7356/75

[51] Int. Cl.[3] ..... C23G 5/00; B24C 1/00

[52] U.S. Cl. ..... 134/7; 51/320; 134/36

[58] Field of Search ..... 134/3, 7, 28, 37, 41, 134/36; 51/319, 320, 321

[56] References Cited

U.S. PATENT DOCUMENTS

| | | | |
|---|---|---|---|
| 832,288 | 10/1906 | Benney | 134/7 UX |
| 1,678,359 | 7/1928 | Schulte | 134/7 X |
| 2,605,596 | 8/1952 | Uhri | 134/7 UX |
| 2,817,195 | 12/1957 | Curtin | 51/321 |
| 3,447,272 | 6/1969 | Eppler | 51/319 |
| 3,775,180 | 11/1973 | Hirata et al. | 134/7 |
| 3,891,456 | 6/1975 | Hohman et al. | 134/7 X |
| 4,038,786 | 8/1977 | Fong | 51/320 |

*Primary Examiner*—Marc L. Caroff
*Attorney, Agent, or Firm*—Kurt Kelman

[57] ABSTRACT

An austenitic steel surface is cleaned of ferritic contaminations and other impurities by blasting it with a wet abrasive mixture containing 40–90% by volume, of corundum having an average grain size of 0.2 to 0.6 mm and of triangular faces. This wet abrasive mixture is accelerated and applied to the surface under a gas pressure of 2.5 to 5.5 atmospheres, 0.8 to 3 kg of corundum being applied per 100 $cm^2$ of the surface to be cleaned. Before the surface has dried, a rinsing liquid is applied thereto.

6 Claims, No Drawings

PROCESS OF CLEANING AN AUSTENITIC STEEL SURFACE

This is a continuation of application Ser. No. 816,864, filed July 18, 1977, now abandoned; which is a continuation-in-part of our copending U.S. application Ser. No. 692,531, filed June 3, 1976, now abandoned.

This invention relates to a process of cleaning surfaces of austenitic steel, particularly to remove ferritic contaminations, by means of an abrasive mixture of corundum and a liquid blasted onto the surface to be cleaned.

Austenitic chromium-nickel steels are known for their resistance to corrosion but, when subjected to corrosive conditions, particularly for a prolonged time, they may suffer damage which may soon require a shutdown of a plant in view of the safety risk. Whereas a passive film forms on stainless steels and protects such materials against the corrosive action of numerous fluids, the passive film may be removed entirely or locally under certain conditions. Active regions are then formed, which may be dissolved at a high rate because they form local couples with the passive environment. The resulting forms of corrosion are typical only for stainless steels and include particularly pitting and intercrystalline corrosion. As these forms of corrosion on austenitic steel surfaces may be initiated by ferritic iron, it is necessary to keep austenitic steel surfaces of workpieces as free as possible from ferritic iron and from firmly adherent deposits in order to avoid these forms of corrosion. This is usually accomplished by removing the surface layer, e.g. by grinding. To ensure a maximum life of such workpieces, their surface is cleaned once more after a certain time of use. For this purpose, a mixture of corundum and water is blasted onto the surface to be cleaned. The resulting effects range from washing to polishing and even to the removal of residues which are due to the use of the workpiece and of slight ferritic contaminations. On the other hand, the use of this known blasting process for treating surfaces of austenitic steel which have not been treated before does not result in the high surface finish and purity, required for vessels of nuclear reactors, for example.

It is an object of the invention to improve the process defined hereinbefore so that surfaces of austenitic steel are cleaned thoroughly of all impurities, such as grease, oil, ferritic contaminations, roll scale and scale which is due to a heat treatment, without the need for prior machining.

It is a more particular object of this invention to prevent the corrosion of austenitic steel surfaces as much as possible by removing ferritic iron and adherent coatings therefrom without impacting the ferritic iron particles in the surface under excessive pressure and rinsing the removed contaminations away before they have dried onto the surface.

It is a specific object of the present invention to obtain thorough cleaning of austenitic steel surfaces without the risk of hammering together surface cracks under high impact pressures of the abrasive cleaning mixture. This avoids the possibility of superficially closing surface cracks and thus permitting faulty work pieces to pass a quality test to which they are submitted after cleaning, superficially closed cracks being readily subject to subsequent corrosion.

It is yet another specific object to avoid surface deformations during the cleaning process due to high impact pressures of the cleaning mixture on the surface and conversion of the austenite to martensite due thereto. Martensite would be subject to corrosion.

The above and other objects and advantages are accomplished in accordance with this invention by blasting a surface of an austenitic steel with an abrasive mixture consisting, by volume of 40% to 90% of corundum and 60% to 10% of a liquid, the corundum having an average grain size of 0.2 to 0.6 mm and the corundum faces triangular habit. The abrasive blasting mixture is accelerated and applied to the austenitic steel surface by a compressed gas under a low pressure in the range of 2.5 to 5.5 atmospheres, the gas pressure increasing in direct proportion to the liquid content in the mixture. From 0.8 to 3 kg of corundum is applied per 100 $cm^2$ of the austenitic steel surface to be cleaned, and a rinsing liquid is applied to the blasted surface before the surface has dried.

For most prevailing operating conditions and austenitic materials, the preferred corundum content in the abrasive blasting mixture is from 50% to 60%, by volume, in which case the preferred gas pressure is about 4.2 atmospheres.

The preferred average corundum grain size of about 0.4 mm and the preferred amount of corundum applied per 100 $cm^2$ of surface is 2 kg.

The preferred amount of rinsing liquid applied to the surface before it has dried is 1 to 10 liters per 100 $cm^2$ of blasted surface.

The technique applied in the blasting process is generally conventional, as exemplified in U.S. Pat. No. 2,605,596, dated Aug. 5, 1952. In such conventional surface cleaning methods, as abrasive blasting slurry is pumped to a blasting nozzle and compressed gas is delivered to the nozzle in a direction substantially normal to the flow of the abrasive blasting slurry to cause substantial envelopment of the compressed gas by the slurry whereby the slurry is accelerated and delivered as a jet to the surface to be cleaned. In the process according to this invention, the blasting jet is directed substantially perpendicularly against the surface to be cleaned.

As the abrasive blasting mixture of the invention is accelerated by a compressed gas, preferably compressed air, at the indicated pressure, the action of the corundum particles is similar to the action in a dry blasting process because the liquid skin which encloses each corundum particle is destroyed to a high degree by the compressed gas and can no longer damp the impact of the corundum particle on the surface to be cleaned. As a result, the surface of the austenitic steel is thoroughly cleaned but ferritic iron particles are not forced into the surface of the steel by the impact because of the relatively low pressure. It will be understood that the gas pressure must be increased as the liquid content of the corundum-liquid mixture is increased.

Whereas it has been found that the use of a gas under a pressure which is selected in dependence on the liquid content enables the surface to be cleaned to a degree which has not been achieved before by a mere blasting, the degree of purity which is required particularly in nuclear reactors is not achieved. The desired characteristics can be ensured only if the blasted surface is also rinsed with a liquid which is applied to the surface before it has dried. This measure appears to prevent a re-adherence of the contaminations on the surface. It is not significant for the process whether additional rinsing liquid is applied simultaneouly with the cleaning blast or subsequently, provided that wet conditions are maintained. The rinsing has the additional advantage that any residual ferritic iron on the cleaned surface becomes visible. The work piece may then be subjected to an additional cleaning treatment. The above indicated amount of rinsing liquid will ensure adequate rinsing of the blasted surface.

Water may be used as the rinsing liquid and the liquid in the abrasive blasting mixture.

If surfaces having a particularly high finish are required, a cleaning pickling liquor, e.g. dilute nitric acid, is applied to the surface when the same has been blasted with the corundum-liquid mixture and before the surface is rinsed.

We have found that, by combining the specific abrasive blasting mixture, gas pressure and amount of corundum applied to the austenitic steel surface to be cleaned, with rinsing the blasted surface before it has dried, excellent cleaning of the surface was obtained without any cracks in the surface being hammered closed by the impact of the blasting mixture. While it was predictable that a lowered impact pressure would prevent this phenomenon, it was unexpected that this lowered blasting pressure will not reduce the effectiveness of the cleaning. However, extended experiments have shown that highly effective cleaning of austenitic steel surfaces was obtained with the process herein disclosed and that the removal of surface impurities could even be enhanced above the extent obtained by dry blasting with this process although surface cracks were not closed thereby.

While we can only speculate about the physical reasons for this result at this time, we assume, without being bound by this theory, that the relatively high corundum content in the wet blasting mixture produces a multiplicity of small chiseling impacts on the surface to clean the same thoroughly. The corundum particles thus chisel the ferritic iron and other impurities out of the austenitic steel surface without, however, causing any substantial deformation thereof.

This effect requires the combination of all the steps in the process, including the shape and size of the corundum grains. They must have triangular faces, i.e. have a plurality of edges, to enable them to chisel the undesirable impurities out of the austenitic steel surface without substantially deforming it. Round particles or particles without rounded edges would not serve this purpose but would tend to hammer cracks in the surface closed.

In view of the assumed operation of the corundum grains with triangular faces as a multiplicity of tiny chisels impacted upon the surface to be cleaned, it could be expected that the particles would be smashed or their sharp edges rounded after short use so that a repeated use of the corundum in this cleaning process would not be possible, thus making it uneconomical. Unexpectedly, we have found this not to be the case and that up to about 50 cleanings can be effectively carried out with this process with the same corundum charge. Used blasting material may readily be cleaned in a centrifugal separator and can then be reused for blasting. The ferritic contaminations remaining on the blasting material are not significant.

The amount of impurities abraded from the surface depends on the amount of corundum applied thereto within the indicated range. We have found that blasting the abrasive mixture at a rate of 1 to 2 kg/100 $cm^2$ was required when a corundum-water mixture containing 40% corundum was used under a gas pressure of 6 bars to remove scale which had been formed by a heat treatment. Blasting material at a rate of 2 to 3 kg/100 $cm^2$ was required to remove roll scale. All specimens inspected were free of ferrites when material had been removed from the surface by blasting to a depth of about 10 to 15 microns. Blasting material at a rate of about 1 to 2 kg per 100 $cm^2$ and about 6 kg/min. was required to remove impurities consisting of grease oil, ferrite dust, and scale formed by annealing. The blast cone had a diameter between 20 and 200 mm on the blasted surface.

The blasting nozzles used to discharge the abrasive mixture onto the austenitic surface may be spaced at a distance of 50 to 500 mm, preferably about 200 mm, the blasting cones at the point of impact on the surface having diameters of 20 to 150 mm, preferably about 50 to 70 mm.

What we claim is:

1. A process of cleaning a surface of austenitic steel, which comprises the steps of (a) blasting the surface with an abrasive mixture consisting, by volume, of 40% to 90% of corundum and 60% to 10% of a liquid, the corundum having an average grain size of 0.2 to 0.6 mm and corundum grains having triangular faces, (1) the abrasive blasting mixture being accelerated and applied to the austenitic steel surface by a compressed gas under a pressure in the range of 2.5 to 5.5 atmospheres, the gas pressure increasing in direct proportion to the liquid content in the mixture, and (2) 0.8 to 3 kg of corundum being applied per 100 $cm^2$ of the austenitic steel surface to be cleaned, and (b) applying a rinsing liquid to the blasted surface before the surface has dried.

2. The cleaning process of claim 1, wherein the abrasive blasting mixture contains 50% to 60%, by volume, of corundum.

3. The cleaning process of claim 2, wherein the gas pressure is about 4.2 atmospheres.

4. The cleaning process of claim 1, wherein the average grain size of the corundum is about 0.4 mm and about 2 kg of corundum is applied per 100 $cm^2$ of the surface to be cleaned.

5. The cleaning process of claim 1, wherein 1 to 10 liters of the rinsing liquid is applied per 100 $cm^2$ of the blasted surface.

6. The cleaning process of claim 1, wherein the austenitic steel surface contains ferritic contaminations and the contaminations are removed by blasting the surface and applying the rinsing liquid thereto.

* * * * *